US006709342B1

(12) United States Patent
Brezic

(10) Patent No.: US 6,709,342 B1
(45) Date of Patent: Mar. 23, 2004

(54) GOLF HOLE INSERT

(76) Inventor: Richard F. Brezic, One Oakshore Dr., Bratenahl, OH (US) 44108

( * ) Notice: Subject to any disclaimer, the term of this patent is extended or adjusted under 35 U.S.C. 154(b) by 222 days.

(21) Appl. No.: 09/771,072

(22) Filed: Jan. 29, 2001

Related U.S. Application Data

(63) Continuation of application No. 09/289,870, filed on Apr. 12, 1999, now abandoned.

(51) Int. Cl.[7] ..... A63B 69/36
(52) U.S. Cl. ..... 473/179
(58) Field of Search ..... 473/180, 179, 473/173–178

(56) References Cited

U.S. PATENT DOCUMENTS

| | | | | | |
|---|---|---|---|---|---|
| 1,882,963 | A | * | 10/1932 | Scanlan | 473/179 |
| 3,870,301 | A | * | 3/1975 | Brisendine | 473/179 |
| 3,874,665 | A | | 4/1975 | Mc Culloch et al. | |
| 4,280,698 | A | * | 7/1981 | Troiano | 473/179 |
| 4,900,023 | A | | 2/1990 | Gelina | |
| 4,928,417 | A | | 5/1990 | Boudreau | |
| 5,078,394 | A | | 1/1992 | Kretz | |
| 5,180,162 | A | | 1/1993 | Browne | |
| 5,205,559 | A | | 4/1993 | Plopper | |
| 5,390,917 | A | * | 2/1995 | Mendoza | 473/179 |
| 5,415,397 | A | * | 5/1995 | Van Holt, Jr. | 473/179 |
| 5,478,071 | A | * | 12/1995 | Barrs et al. | 473/176 |
| 5,524,891 | A | * | 6/1996 | Owen, Jr. et al. | 473/196 |
| 5,674,131 | A | | 10/1997 | Forbes et al. | |
| 5,776,004 | A | * | 7/1998 | Wilson | 473/179 |
| 6,110,053 | A | * | 8/2000 | Sjoblom | 473/179 |
| 6,267,688 | B1 | * | 7/2001 | Morelli, Sr. | 473/179 |

OTHER PUBLICATIONS

Golf Gopher Gotcha™ advertisement from Internet website, Forbes Dickerson & Associates.

* cited by examiner

*Primary Examiner*—Mark S. Graham
(74) *Attorney, Agent, or Firm*—Fay, Sharpe, Fagan, Minnich & McKee

(57) ABSTRACT

A golf insert designed to at least partially obstruct a golf ball from dropping into a golf hole. The golf insert includes a cover that at least partially obstructs the opening in a golf hole, and a cover mount to secure the cover in place about the golf hole. The cover mount is designed to provide easy insertion and removal of the cover about the golf hole. The cover can be configured so as to use the golf hole insert as a golf novelty and/or as a skill enhancing tool.

46 Claims, 17 Drawing Sheets

GOLF HOLE INSERT

This patent application is a continuation of application Ser. No. 09/289,870 filed on Apr. 12, 1999, abandoned, and incorporated herein by reference.

The present invention relates to the art of golf, and more particularly to a accessory that is placed about the golf hole to obstruct the opening in the golf hole.

BACKGROUND OF THE INVENTION

Many devices have been developed for the game of golf to improve a players skill level and to increase the level of enjoyment of the game. Much of the focus of golf occurs at the putting green, since the principle object of the game is to sink a golf ball into a golf hole with the least amount of strokes. Several devices have been developed to improve the players ability to put a golf ball into a golf hole.

One group of these devices is designed to reduce the diameter of the golf hole to improve the aim of a player hitting a golf ball into the center of the golf hole. Typically, these devices are inserted into the golf hole so as not to obstruct the ground surface around the golf hole. The golfer, after putting the golf ball into the golf hole, is required to remove the insert from the golf hole prior to retrieving the golf ball. One such device is disclosed in U.S. Pat. No. 5,415,397. The golf hole insert has an outer diameter the same as a regulation golf hole and includes a tapered edge to allow the insert to be inserted into the golf hole. The top of the device has an opening with a diameter less than the diameter of the golf hole, but greater than the diameter of a golf ball so as to allow the golf ball to drop through the opening and into the golf cup. A modifications to this device accommodates an insert to be placed in the opening to further reduce the diameter of the opening and make it more difficult to sink the golf ball in the smaller opening.

Another group of devices incorporate the use of visual markers to visually enhance the area in and around the golf hole. These devices include colored markings and are positioned about the perimeter of the golf hole to focus the players attention on the golf hole. These devices may also include advertising and other informational marking to provide various types of information to a player during play.

A further group of devices are designed to eject a golf ball from a golf hole after the golf ball falls into the golf hole. These ejectors incorporate mechanical, hydraulic and/or electrical components to eject the golf ball. These devices are typically designed to eject upon being activated by a player. However, other devices are designed to automatically eject the golf ball when the golf ball contacts the device or after some period of time after the golf ball contacts the device. These ejectors typically are designed to provide convenience to a player so that the player does not need to bend down and retrieve the golf ball from the golf hole. However, the device designed to immediately eject the golf ball from the golf hole may have some novelty aspects, especially when the golfer is not aware of the placement of the device in the golf hole. One such golf hole device is disclosed in U.S. Pat. No. 5,674,131.

Golf cup inserts which reduce the diameter of a golf hole traditionally require the player to remove the insert prior to being able to remove the ball from the golf hole thus making such devices inconvenient for practice. These golf cup inserts are designed to fit into officially cut golf holes having a diameter of about 4.25 inches. Golf holes that have a smaller diameter or a substantially larger diameter than regulation golf holes cannot properly accommodate these devices thus causing the insert not to fit into the golf hole or dropping through the hole.

SUMMARY OF THE INVENTION

The present invention relates to a golf hole insert to reduce or obstruct the opening of a golf hole to prevent a golf ball from fully passing through the opening and into the golf cup. The golf hole insert may be used as a practicing tool to increase the skill of a player and/or a novelty item which creates an obstruction in the golf hole to prevent an unknowing player from hitting the golf ball into the golf hole.

In accordance with the present invention there is provided a golf hole insert that is placed about a golf hole. The insert includes a cover that is shaped to prevent the golf ball from fully passing through the opening of a golf hole. The cover can have a variety of shapes to obstruct the path of the golf ball into the golf hole. These shapes include, but are not limited to, a circle, an oval, or a polygonal shape such as a square, rectangle, rhombus, pentagon, hexagon, octagon or the like. In one preferred embodiment, the cross-sectional shape of the cover along its horizontal axis is a generally circular shape. Preferably, the cover has a cross-sectional shape to enable the insert to be positioned within the golf hole. For covers having a generally circular cross-sectional shape, the diameter of the cover is preferably selected to be equal to or slightly less than the diameter of 4.25 inches regulation golf hole. To accommodate a variety of different golf holes, the diameter of a generally circular cover is at least about 3.0 inches, and preferably about 3.5 to 4.75 inches in diameter. As can be appreciated, the cover can be designed so that one or more portions of the cover overlie the ground around the golf hole. For a generally circular shaped cover, the diameter of the cover would be greater than the diameter of the golf hole. Cover designs having shapes to allow the cover to be inserted into the golf hole can be mounted such that at least a portion of the cover is positioned level with the ground surface about the golf hole, positioned below the ground surface around the golf hole, and/or positioned above the ground surface of the golf hole. The positioning of the cover with respect to the ground surface is dependent on the particular application and use of the golf insert.

In accordance with another aspect of the present invention, the golf hole insert can be designed to draw attention to the golf hole insert or to reduce detection by a player. The selection of whether to use or not to use golf hole inserts that draw attention to itself depends upon the intended use of the golf hole insert. When the golf insert is used to improve a player's golf skills, the insert preferably includes one or more markings to draw attention to the golf hole insert. These markings can include coloring which enable a player to easily identify the location of the insert. In one preferred embodiment, the markings include colored visual aids positioned on the top surface of the cover such as a colored stripe. In another preferred embodiment, the visual markings include advertisement material and/or other informational markings to provide the player with information. When the golf hole insert is designed to not draw a player's attention, the cover may include camouflaged markings and/or transparent materials. Typically, such a cover is used as a novelty item to surprise a player upon seeing the golf ball roll toward the golf hole being deflected from the golf hole or not passing fully into the golf hole. When camouflaged markings are used, the markings are preferably included on the top and/or bottom surface of the cover to visually emulate the appearance of a golf hole.

In accordance with still another aspect of the present invention, the top portion of the cover can be designed to have a variety of shapes. The shape of the top of the cover will generally depend on the intended use of the golf insert. In one preferred embodiment, the top portion is substantially planar or flat. The flat surface allows the golf ball to roll across the top portion without any obstruction. In another preferred embodiment, the top portion includes one or more concave and/or convex dimples or bulges. These dimples and bulges produce obstructions and/or traps as the golf ball rolls across the top portion of the cover. In still another preferred embodiment, the top portion is generally concave or domed shape. The dome shape causes the golf ball to reduce speed and/or to alter its course as it moves along the dome. In a further preferred embodiment, the top portion is generally convex or well-like. The convex shape acts as a cup to retain the golf ball and/or modifies the path of the golf ball as it passes on the convex surface. As can be appreciated, the top of the cover can include one or more of these or additional configurations.

In accordance with yet another aspect of the present invention, the cover includes one or more openings positioned at the side of the cover and/or spaced from the side of the cover. The opening or openings are designed to enable a user to easily grasp the cover when inserting and removing the golf insert from the golf hole. The one or more openings can also be used to receive a portion of the golf ball when fallen into the opening. The one or more openings in the cover may extend partially or completely through the cover. The opening can include a variety of shapes. The opening is designed to have a shape and size which does not allow a standard sized golf ball to pass completely through the opening. Inserts that include an opening generally in the center of the cover can be used to improve the skill of the golfer. The opening provides a significantly smaller target for the player to aim, thus requiring the player to improve his or her skill at hitting the golf ball toward the center of the golf hole. The small openings in the cover entraps the ball only if the golf ball is hit into the opening and at a slow speed so that the momentum of the golf ball does not cause the golf ball to roll out of the opening. Therefore, the golfer must not only aim the golf ball at the center of the hole, but also hit the golf ball at a speed which would cause the golf ball to just get to the golf hole or slightly past the golf hole thereby improving the golfer's accuracy and speed when hitting a golf ball toward the golf hole. The design and shape of the opening prevents the golf ball from falling into the hole, thus enabling the player to retrieve the golf ball without having to first remove the insert. When the golf insert is used as a novelty, the opening prevents the golf ball from falling into the golf hole, thus surprising a player who thought he made the put. In one preferred embodiment, the cover includes at least one single opening positioned substantially in the center of the cover. In one specific embodiment, the center opening is substantially circular. Preferably, the center circular opening extends completely through the cover. In another preferred embodiment, the cover includes at least one opening positioned at the edge of the cover. In a specific embodiment, the opening has a general U-shape. The edge opening preferably extends clearly through the body of the cover. In still another preferred embodiment, the cover includes a plurality of openings generally geometrically spaced about the cover. Preferably, the openings have generally the same shape.

In accordance with still another aspect of the present invention, the golf hole insert includes a mount mechanism or retaining mechanism to secure the cover about the golf hole. The mount mechanism is designed to easily insert the golf hole insert in a desired location about the golf hole and/or easily remove the golf hole insert from the golf hole after use without damaging the golf hole or the ground around the golf hole. In one preferred embodiment, the mount arrangement includes an extension member that is secured in a generally ridged position on the side of the golf hole insert and extends or protrudes outwardly from the side of the golf hole insert. In one specific embodiment, the extension member is a generally cylindrically shaped pin that is at least partially inserted into the side of the golf hole insert and is rigidly secured therein to prevent the pin from retracting further into the body of the golf hole insert or be released from the body of the golf hole insert. One end of the pin is designed to engage the cup within the golf hole, engage the ground around or within the golf hole, and/or to penetrate into the ground in the golf hole to secure the golf hole insert in place about the golf hole. The pin can form the sole means to maintain the golf hole insert about the golf hole, or can be used in combination with other mounting mechanisms to secure the golf hole insert about the golf hole. In accordance with another preferred embodiment, the mounting arrangement includes one or more moveable extension members or fingers. The fingers are designed to engage and/or disengage the cup within the golf hole, engage the ground around or within the golf hole, and/or penetrate into the ground in the golf hole to secure the golf hole insert in place about the golf hole. In one specific embodiment, the mounting arrangement includes one or more passageways extending partially or completely through the body of the golf hole insert. The passageways are shaped to accommodate one or more fingers and to allow such fingers to move therein. Preferably, the fingers are generally cylindrically shaped rods and are inserted into a generally cylindrical passageway having a diameter that is larger than the diameter of the finger. Preferably, the passageways are oriented generally parallel to the horizontal plane of the mid-section of the golf hole insert; however, the passageways may have other orientations. If two or more fingers and passageways are used, the passageways are preferably oriented to not intersect one another; however, such intersection can exist. Preferably, one end of the finger includes a head section sized larger than the passageway opening to prevent the heads from passing into the passageway. The length of the finger is selected such that when one end of the finger moves toward the opening of the passageway, the other end of the pin at least partially extends beyond the other opening in the passageway. When the golf hole insert is to be secured about the golf hole, one or more of the moveable fingers is moved within the passageway so that at least one end of the finger engages the cup within the golf hole and/or the ground in or around the golf hole to secure the golf hole insert about the golf hole. The moveable finger can be used by itself or in combination with other mounting arrangements to secure the golf hole insert about the golf hole. When a plurality of movable fingers are used, or one or more fingers are used in combination with another mounting arrangement, the mounting arrangements are preferably oriented symmetrically about the golf hole insert; however, other orientations can be used. In accordance with still another preferred embodiment, the mounting arrangement includes one or more retractable extension members. In one specific embodiment, the extension member is a generally cylindrically shaped pin positioned in a slot on the side of the golf hole insert. The slot is preferably designed to telescopically receive at least a portion of the pin; however, other dimensions of the slot can be used. In a specific embodiment, the pin is biased in an extended position wherein at least a portion of the extension member extends beyond the side of the golf hole insert. The biasing of the pin can be accomplished by a mechanical, hydraulic, electrical means or the like. Preferably, the pin is biased by a spring positioned in the slot. In another specific embodiment, the pin has limited movement in the slot to prevent the pin from being removed from the slot. In operation, one or more retractable pins are retracted prior to inserting or removing the golf hole insert about the golf hole. When positioning of the golf hole insert about the golf hole, the golf hole insert is oriented in the desired position and the one or more pins is released thereby allowing the end of the pin to move to an extended position. The one or more pins are designed to contact the golf cup within the golf hole, contact the inside of the golf hole, and/or contact the ground around the golf hole to secure the golf hole insert about the golf hole. One or more retractable pins can be used to secure the golf hole insert in position, or be used in combination with other mounting arrangements to secure the cover in position. If a plurality of mounting arrangements are used, the mounting arrangements are preferably oriented generally symmetrically about the cover; however, other orientations can be used. In accordance with still yet another preferred embodiment, the mounting arrangement includes one or more hook members. The hook members are preferably secured to the top of the cover. The hook members may be rigidly secured or secured so as to rotate and/or slide on the cover. Preferably, the hook member includes at least one leg member designed to rest upon and/or penetrate into the ground around the golf hole. In one specific embodiment, the hook is generally a U-shaped structure wherein one leg of the U-shaped structure is secured to the cover and the other leg is designed to contact and/or be inserted into the ground surface around the golf holes. In another specific embodiment, the leg of the U-shaped member secured to the cover is the longer of the two legs. One or more hook members may be used to secure the cover in position about the golf hole, or used in combination with other mounting arrangements to secure the cover about the golf hole. If a plurality of mounting arrangements are used, the mount arrangements are preferably oriented generally symmetrically about the cover; however, other orientations can be used. In accordance with a further preferred embodiment, the mounting arrangement includes a tapered or bubbled surface on the side of the cover. Preferably, the complete side of the cover tapers uniformly toward the center of the cover; however, the taper may constitute only a portion of the side wall and/or taper in a non-uniform manner. In one specific embodiment, a flange having a tapered edge is connected to the side of the cover which flange extends some distance downwardly from the body of the cover. Preferably, the bottom edge of the flange has a cross-sectional shape to allow the bottom portion of the flange to be freely inserted into the opening of the golf hole. The top portion of the flange is preferably shaped such that it engages at least a portion of the inside surface of the golf hole to thereby secure the cover within the golf hole. In one specific embodiment, the flange forms a generally circular surface about the cover. In another specific embodiment, one or more bulges or bumps are positioned on the tapered surface to contact the inside surface of the golf hole opening to assist in securing the cover about the golf hole. The tapered surface, with or without bulges or bumps, can be the sole mounting mechanism to secure the cover about the golf hole or can be used in combination with other mounting arrangements to secure the cover about the golf hole.

In accordance with another aspect of the present invention, the top portion of the cover is mounted about the golf hole such that at least a portion of the top portion of the cover is mounted above, even with, and/or below the ground surface around the golf hole. The intended use of the golf insert will generally dictate the orientation of the top portion of the cover with respect to the ground surface. When the golf insert is to be used as a novelty device, at least a majority of the cover is preferably mounted below the ground surface to reduce the chance that the insert will be discovered by the unknowing player. When the golf insert is being used as a practice and/or skill aid, the golf insert is preferably oriented such that the top portion is level with or at least a portion of the insert is positioned above the ground surface around the golf hole so as to draw attention to the insert.

In accordance with a further aspect of the present invention, the cover and mounting arrangements are made of a resilient material that resists corrosion and breakage. Preferably, the cover is made of a plastic material, rubber material, fiberglass material, graphite material, wood material, and/or metallic material. The cover can be treated or coated with a protective material to inhibit and/or prevent corrosion and/or absorption of liquids. In one specific embodiment, the cover is made of a plastic material. In one specific embodiment, the cover is made of a hard plastic material that has been blow molded or injection molded. Preferably, the mount arrangements such as pins, hooks, springs and the like are made of a material similar to the cover. In one specific embodiment, the pins and/or hooks are made of plastic, wood and/or metal. In another specific embodiment, the spring is made of metal.

The primary object of the present invention is the provision of a golf hole insert that is inserted about the golf hole to at least partially obstruct the opening of the golf hole.

Another object of the present invention is the provision of a golf hole insert that improves the skill of a golf player.

Still another object of the present invention is the provision of a golf hole insert which functions as a golf novelty.

Yet another object of the present invention is the provision of a golf hole insert which prevents a golf ball from fully passing through an opening in a golf hole.

A further object of the present invention is the provision of a golf hole insert which includes markings to draw attention to the golf insert.

Still a further object of the present invention is the provision of a golf hole insert made of certain materials and/or includes markings to camouflage the golf insert.

Another object of the present invention is the provision of a golf hole insert made of certain materials and/or includes markings to draw attention to the golf insert.

A further object of the present invention is the provision of a golf hole insert wherein at least a portion of the insert is positioned above the ground surface around the golf hole.

Another object of the present invention is the provision of a golf hole insert wherein at least a portion of the insert is positioned substantially level with the ground around the golf hole.

Yet another object of the present invention is the provision of a golf hole insert wherein at least a portion of the insert is positioned below the ground around the golf hole.

Still yet another object of the present invention is the provision of a golf hole insert which includes a top portion designed to obstruct the path of a golf ball upon passing over the top portion of the cover.

A further object of the present invention is the provision of a golf hole insert which can be easily inserted and removed about a golf hole without damaging the golf hole and/or region about the golf hole.

Still another object of the present invention is the provision of a golf hole insert which includes one or more rigidly positioned extension members to secure the cover about the golf hole.

Another object of the present invention is the provision of a golf hole insert which includes one or more adjustable and/or nonadjustable hook members to secure the cover about the golf hole.

Still a further object of the present invention is the provision of a golf hole insert which includes one or more biased extension members which can be retracted to secure the golf hole insert about the golf hole.

Yet a further object of the present invention is the provision of a golf hole insert which includes one or more moveable extension members to secure the golf hole insert about the golf hole.

Still another object of the present invention is the provision of a golf hole insert which includes one or more tapered edges to secure the golf hole insert about the golf hole.

Another object of the present invention is the provision of a golf hole insert which includes one or more bulges about the sides of the insert to secure the golf hole insert about the golf hole.

Still a further object of the present invention is the provision of a golf hole insert which is made up of a resilient, corrosion resistant material.

Still yet a further object of the present invention is the provision of a golf hole insert which is simple to use and can be easily inserted and removed about a golf hole.

Another object of the present invention is the provision of a golf hole insert which is economical to manufacture and simple to utilize.

These and other objects and advantages will become apparent to those skilled in the art upon reading the following description taken together with the accompanied drawings.

BRIEF DESCRIPTION OF THE DRAWINGS

Reference may now be made to the drawings, which illustrate various embodiments of the invention which may take a physical form and in certain parts and arrangements and parts wherein.

DESCRIPTION OF THE PREFERRED EMBODIMENTS

Figure 1:
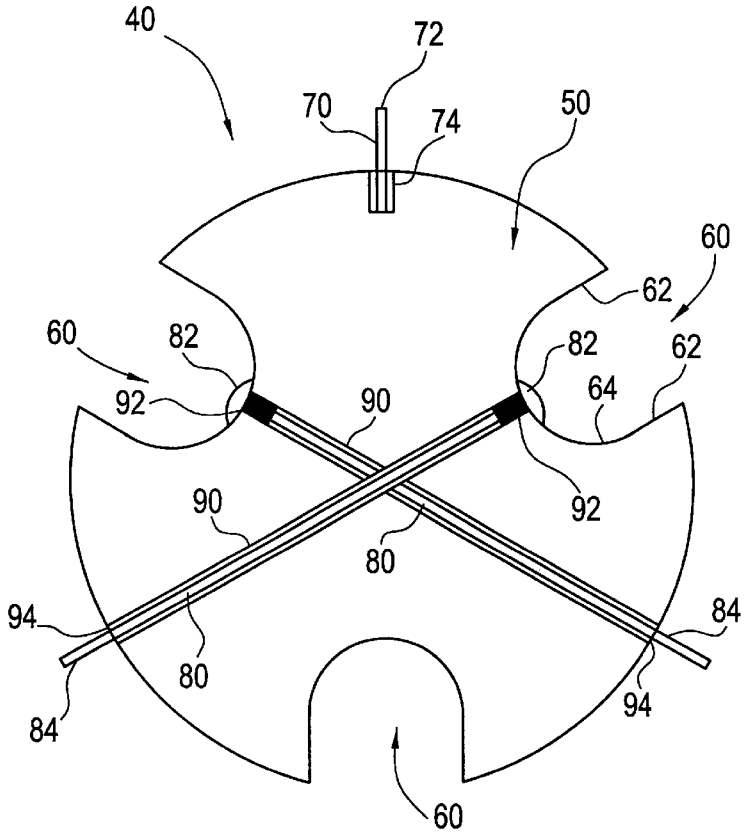
FIG. 1 is a top-elevation view of the golf hole insert in accordance with the present invention.
Figure 2:
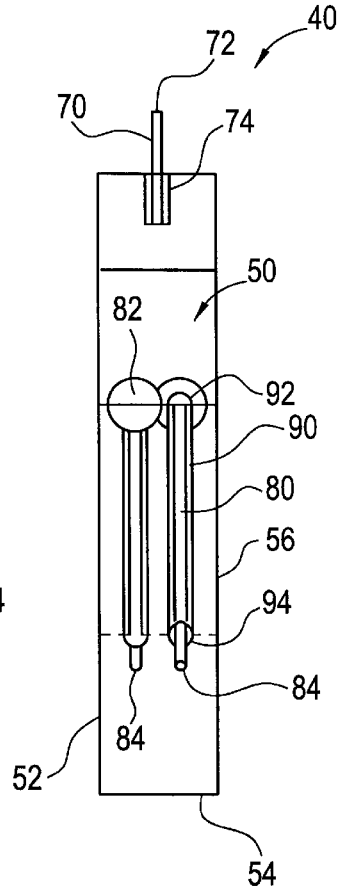
FIG. 2 is a cross-sectional view of the side of the golf hole insert of FIG. 1.
Figure 34:
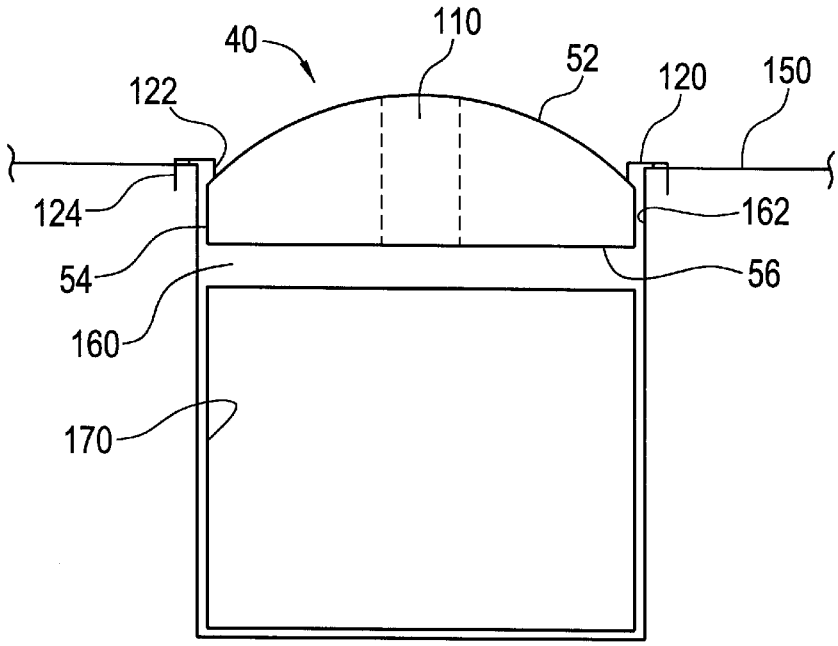
FIG. 34 is a cross-sectional view of the golf hole insert positioned in a golf hole.

Referring now to the drawings, wherein the showings are for the purposes of illustrating the preferred embodiments of the invention only and not for the purpose of limiting the same, reference is first had to FIGS. 1 and 2, which illustrates one embodiment of a golf hole insert of the present invention. Golf hole insert 40 includes a cover 50 which is designed to prevent a golf ball from fully passing through the opening in a golf hole. As shown in FIG. 34, golf insert 40 is positioned about golf hole 160 so as to prevent a golf ball, not shown, from passing through cover 50, and then passing through the golf hole and into golf cup 170. The diameter of the generally circular cover 50 is selected to prevent a golf ball from fully bypassing the cover and falling into the golf hole. Regulation golf holes have a hole diameter of about 4.25 inches. The diameter of the cover 50 for use in standard golf holes is generally about 3.5 to 4.25 inches.

Referring again to FIGS. 1 and 2, cover 50 includes a generally circular body made up of a top portion 52, a side portion 54 and a bottom portion 56. Three indents 60 are positioned on the cover and are generally symmetrically oriented about the outer perimeter of the cover. The indents include two generally parallel legs 62 that abuts against arc insert 64 to form a generally U-shaped indent. The spacing between the two legs 62 is selected so as to allow a user to insert one or more fingers into the indent to facilitate in the insertion and removal of the golf hole insert from the golf hole. The size and shape of indent 60 is selected to not allow a golf ball to pass completely through the indent or to bypass the indent when the cover is positioned about the golf hole. Preferably, the space between legs 62 of indent 60 is about 0.5 to 1.25 inches.

The side portion 54 of cover 50 includes a pin 70 which is partially inserted into a pin slot 74. Pin 70 is immovably secured in pin slot 74. Pin 70 can be secured in slot 74 by any conventional mechanism such as a resistance connection, glue or the like. Pin end 72 is designed to extend outwardly from side portion 54 and contact and/or penetrate into hole surface 162 of golf hole 160. Cover 50 also includes two fingers 80. Fingers 80 include a head 82 and end 84. Fingers 80 are positioned in a passage 90 having two openings 92 and 94. The head 82 of finger 80 is designed to prevent the head from passing into passage opening 92. Head 82 also functions as a grasping point so that a user can move finger 80 within passage 90. End 84 of finger 80 is designed to contact or penetrate into hole surface 162 of golf hole 160. As best shown in FIG. 1, the two finger ends 84 and pin end 72 are generally symmetrically oriented about the side portion 54 of cover 50. In addition, pin slot 74 and the two passages 90 are oriented to be generally parallel to the central plane of cover 50.

Figure 3:
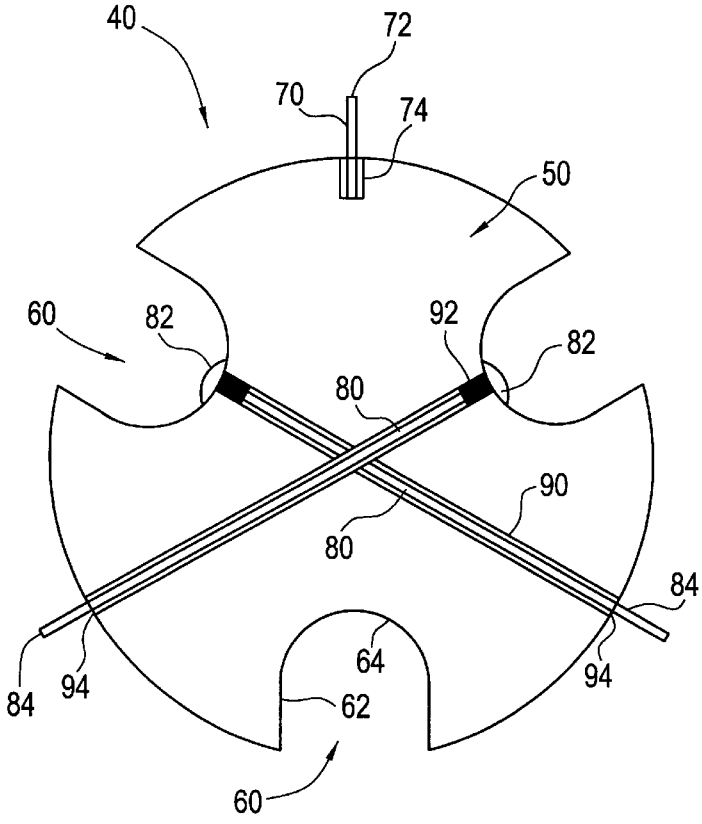
FIG. 3 is a top-elevation view of an alternative embodiment of the golf hole insert in accordance with the present invention.
Figure 4:
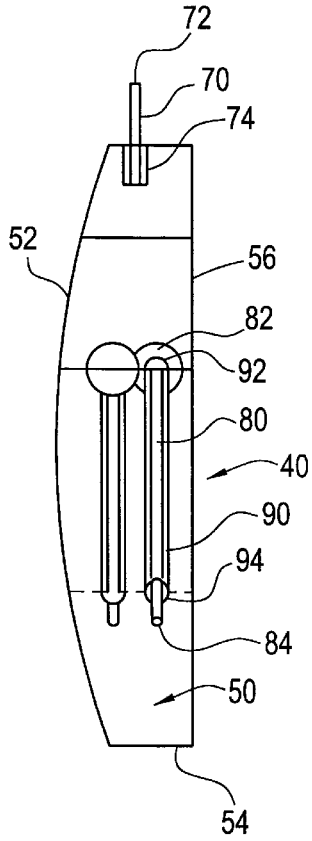
FIG. 4 is a cross-sectional view of the side of the golf hole insert of FIG. 3.
Figure 5:
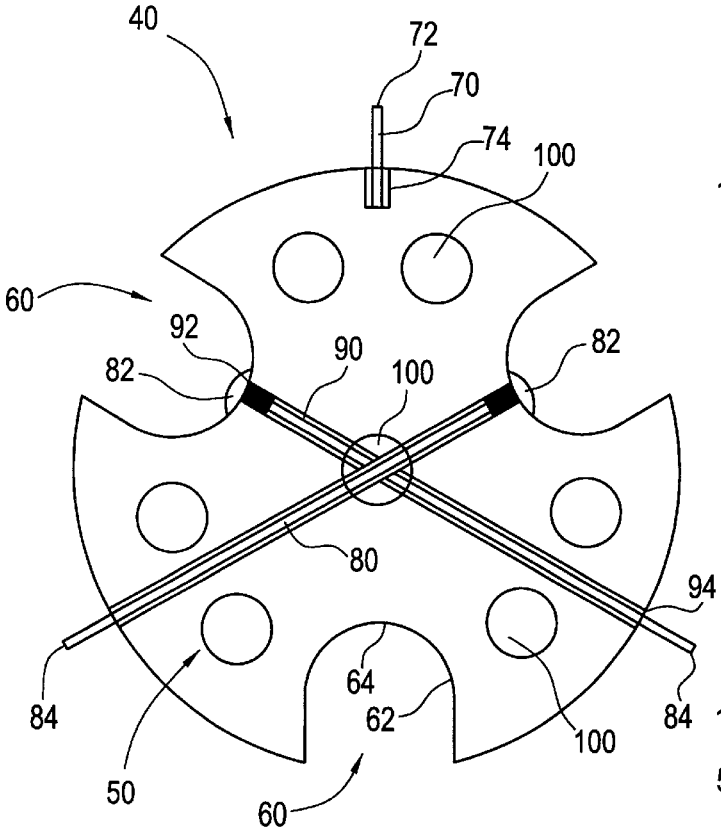
FIG. 5 is a top-elevation view of another alternative embodiment of the golf hole insert in accordance with the present invention.
Figure 6:
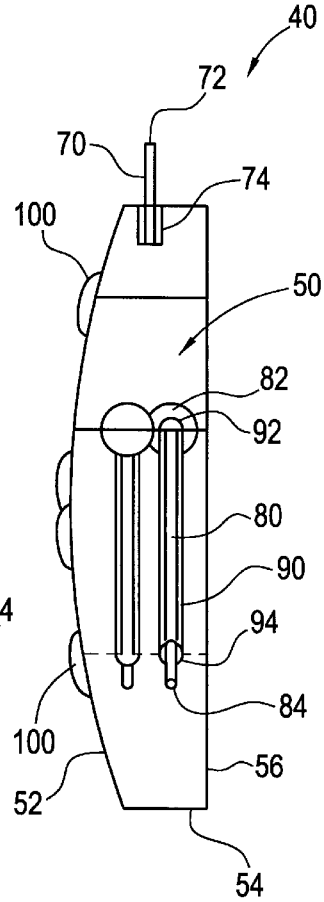
FIG. 6 is a cross-sectional view of the side of the golf hole insert of FIG. 5.
Figure 7:
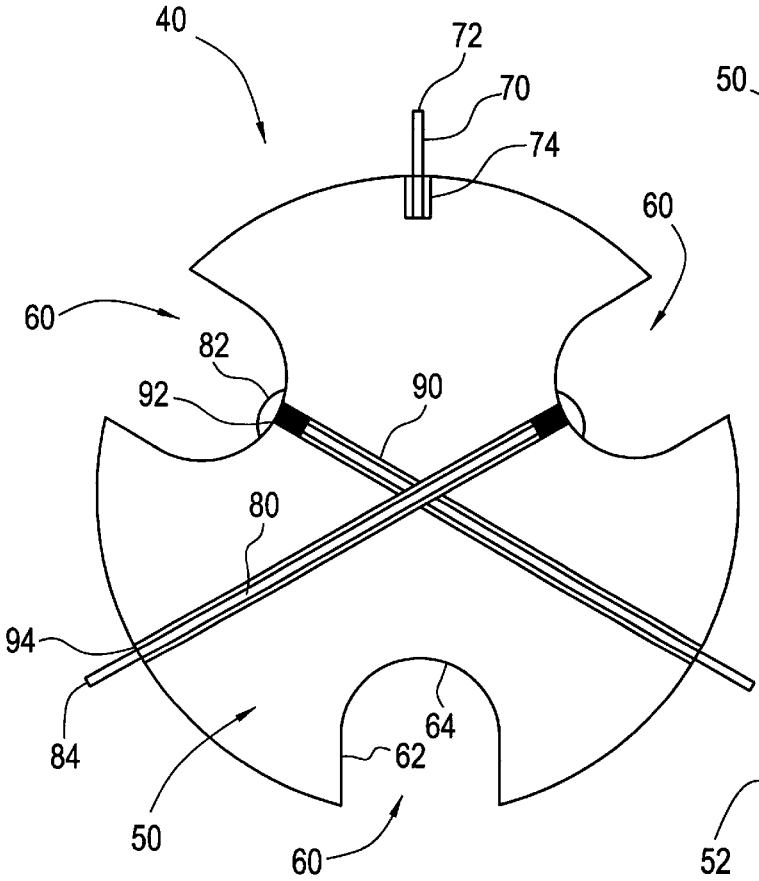
FIG. 7 is a top-elevation view of still another alternative embodiment of the golf hole insert in accordance with the present invention.
Figure 8:
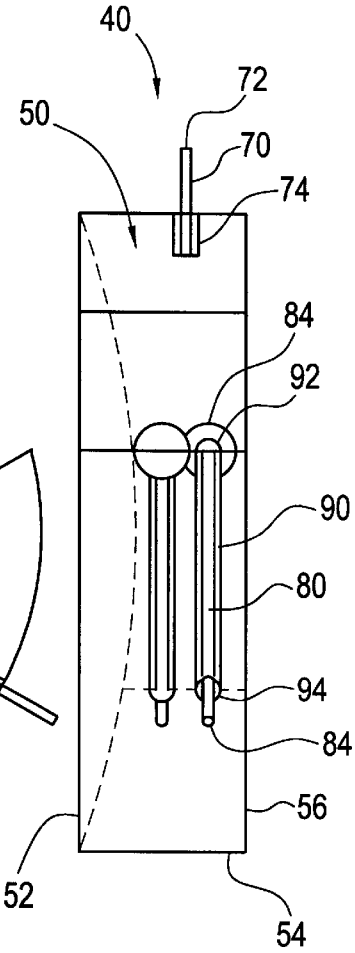
FIG. 8 is a cross-sectional view of the side of the golf hole insert of FIG. 7.

As shown in FIG. 2, top portion 52 is a generally planar or flat surface. Alternate embodiments of the top portion of cover 50 are disclosed in FIGS. 3–8. Specifically, FIGS. 3 and 4 disclose a top portion which is generally concave or dome shaped. FIGS. 5 and 6 disclose a top portion which is a generally concave or dome shaped surface and includes a plurality of bulges or dimples 100 positioned about the top portion. As best shown in FIG. 5, the plurality of bulges are generally symmetrically oriented about the top portion of cover 50; however, other orientations can be used. FIGS. 7 and 8 disclose a top portion which includes a generally convex or well shape. As can be appreciated, other configurations of the top portion can be used.

The golf insert is designed to be easily inserted and removed about the golf hole without damaging the golf hole or the surrounding area. The golf insert disclosed in FIGS. 1–8 are inserted into the golf hole by first retracting finger heads 82 from passage opening 92 until finger end 84 retracts closely to or in passage opening 94. Indents 60 are used by the player to conveniently grasp cover 50 during the insertion of the golf hole insert about golf hole 160. Cover 50 is then positioned in the desired location of the golf hole and the side portion of the cover which includes pin 70 is moved toward golf hole surface 162 to cause pin end 72 to contact and/or penetrate into the side of golf hole 160. Once pin end 72 is positioned, the pin acts as an anchor to allow the player to properly orient the cover about the golf hole. Once the cover is properly oriented, finger ends 82 are moved toward passage opening 92 thereby causing finger ends 84 to contact or penetrate into golf hole surface 162 thereby securing cover 50 about golf hole 160. When golf hole insert 40 is to be removed from golf hole 160, the ends 84 of fingers 80 are retracted and the golf insert is lifted from golf hole 160.

Referring now to FIGS. 9–16, an alternate mounting mechanism to secure golf insert 40 about golf hole 160 is disclosed. The side portion 54 of cover 50 includes three pins 70 which are generally symmetrically oriented about the perimeter of side portion 54. Pins 70 are positioned in a pin slot 74 and are designed to be at least partially retracted into the pin slot. Pins 70 are shown to be biased in a partially extended position by a pin spring 78 which is positioned between pin base 76 and the base of pin slot 74. Preferably, pin 70 is designed so that it can partially move within pin slot 74, but cannot be removed from the pin slot. Pin ends 72 of pin 70 can be tapered to facilitate in the insertion of the pin ends into the ground about golf hole 160.

The retractable pins facilitate in the insertion or removal of cover 50 about golf hole 160. When inserting cover 50 about golf hole 160, one or more of pins 70 are depressed at least partially into pin slot 74. While the pins remain at least partially depressed, cover 50 is inserted into a desired position about golf hole 160. After cover 50 is properly positioned, the pins are released thereby allowing pin spring 78 to cause pin end 72 to extend outwardly and engage and/or penetrate golf hole surface 162. Alternatively, after the first pin is embedded or in contact with the golf hole, the golf insert is moved to cause the other pins to embed or come in contact with the golf hole, thereby resulting in all, or the majority, of the pins to contact and/or embed in the golf hole. As illustrated in FIGS. 9–16, cover 50 includes an opening 110. Opening 110 enables a user to conveniently grasp cover 50 during the insertion and removal of the cover from golf hole 160. Opening 110 is shown to be positioned substantially in the center of top portion 52 and extending completely through cover 50. As can be appreciated, the orientation and/or depth of the opening can be varied. Opening 110 is also shown to have a generally circular shape; however, other shapes may be used for the opening. The opening is sized so as to allow the user to insert one or more fingers into the opening. The size of the opening is also selected to prevent a golf ball, with a regulation size of about 1.75 inches in diameter, from completely passing through the opening. For generally circular openings, the diameter of the opening is preferably about 0.5 to 1.25 inches.

Figure 9:
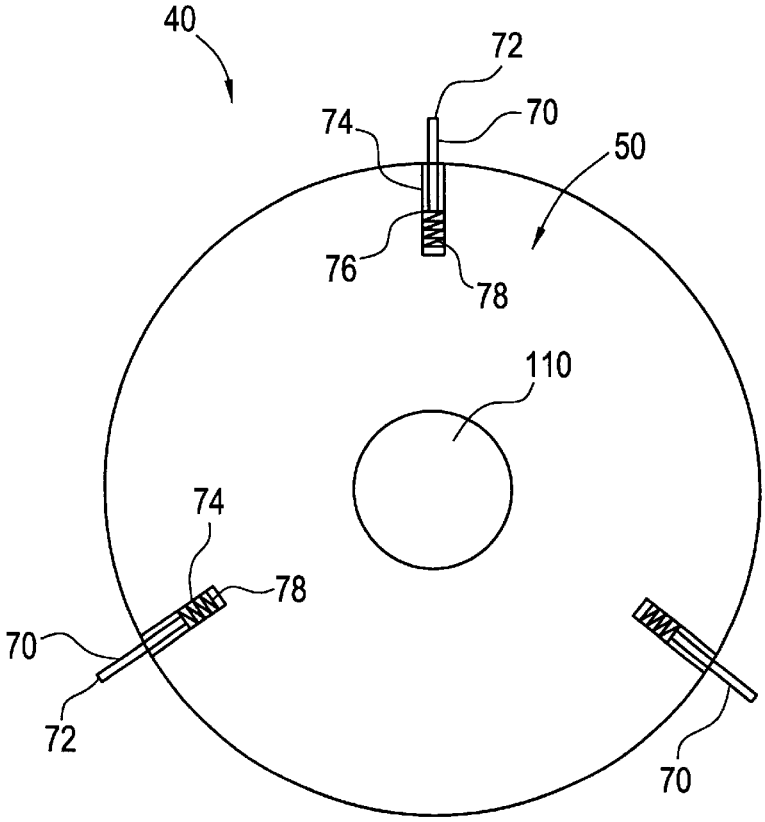
FIG. 9 is a top-elevation view of yet another alternative embodiment of the golf hole insert in accordance with the present invention.
Figure 10:
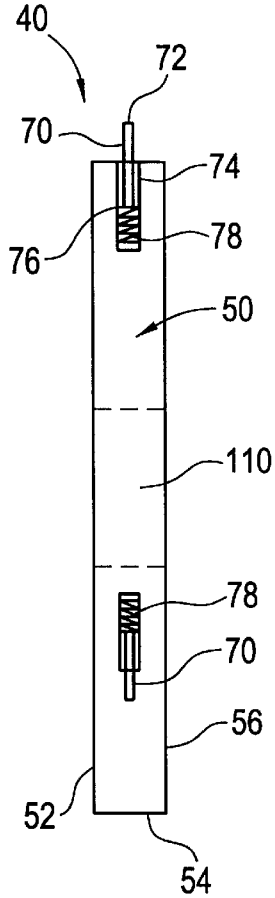
FIG. 10 is a cross-sectional view of the side of the golf hole insert of FIG. 9.
Figure 11:
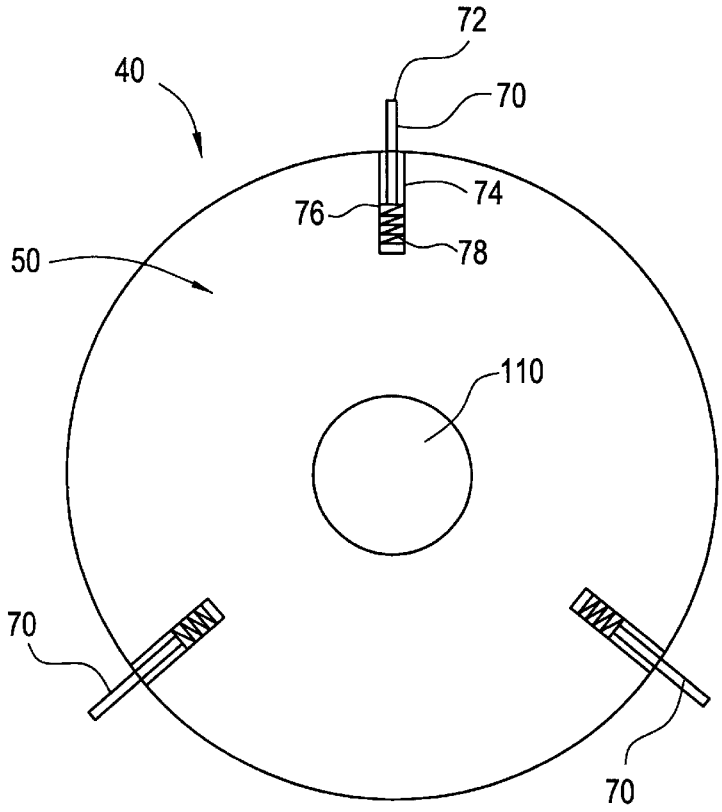
FIG. 11 is a top-elevation view of still yet another alternative embodiment of the golf hole insert in accordance with the present invention.
Figure 12:
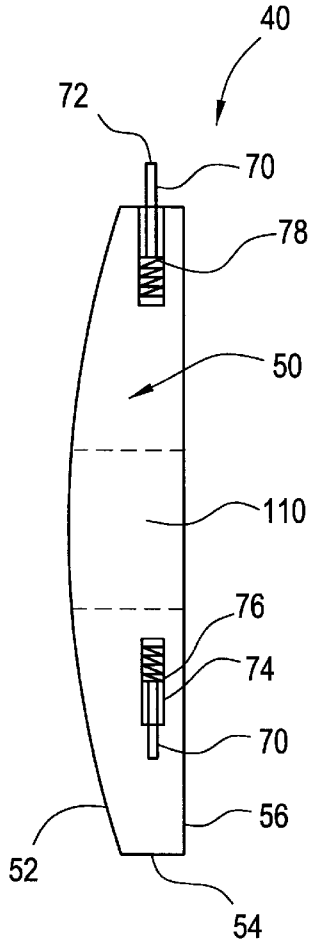
FIG. 12 is a cross-sectional view of the side of the golf hole insert of FIG. 11.
Figure 13:
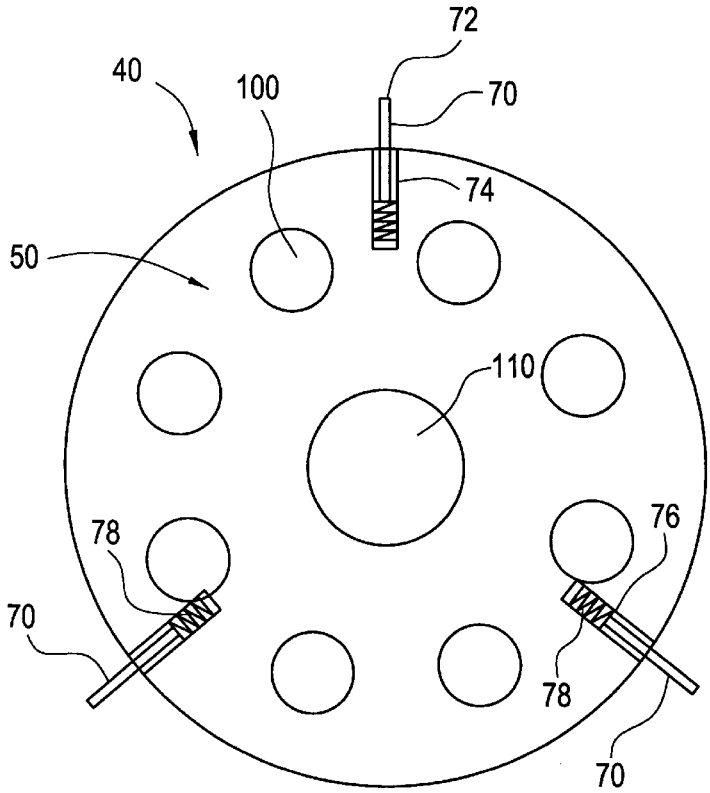
FIG. 13 is a top-elevation view of a further alternative embodiment of the golf hole insert in accordance with the present invention.
Figure 14:
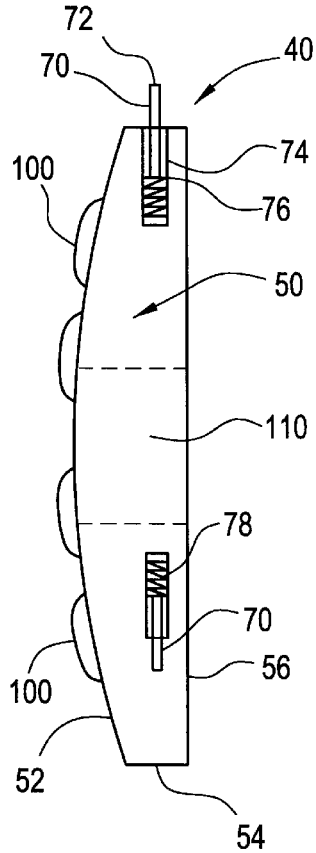
FIG. 14 is a cross-sectional view of the side of the golf insert of FIG. 13.
Figure 15:
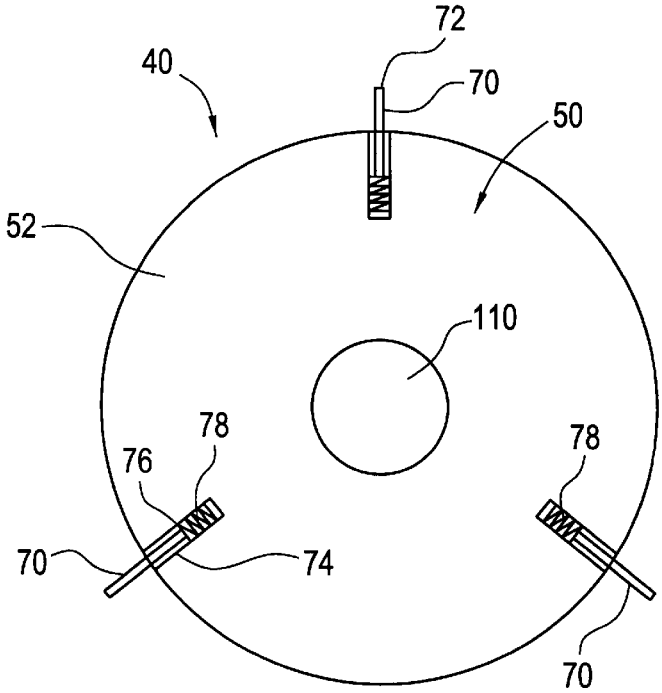
FIG. 15 is a top-elevation view of still a further alternative embodiment of the golf hole insert in accordance with the present invention.
Figure 16:
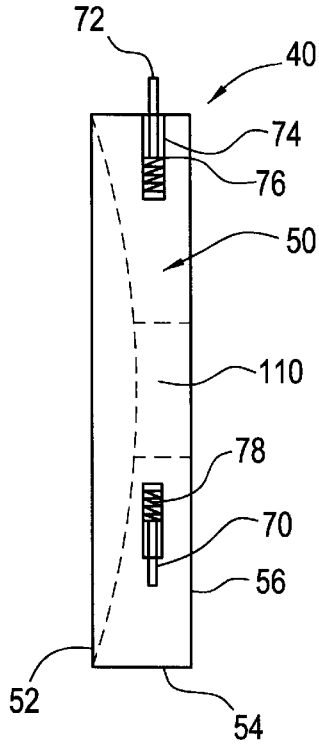
FIG. 16 is a cross-sectional view of the side of the golf hole insert of FIG. 15.

FIGS. 9–16 disclose various configurations of top portion 52. FIGS. 9 and 10 disclose the top portion as having a generally flat or planar shape. FIGS. 11 and 12 disclose the top portion as having a generally concave or dome-like shape. FIGS. 13 and 14 disclose the top portion as having a generally concave or dome-like shape which includes a plurality of bulges or dimples 100 positioned about the top portion. As best shown in FIG. 13, the plurality of bulges are symmetrically oriented about the top portion of cover 50; however, other orientations can be used. FIGS. 15 and 16 disclose a generally convex or well-shaped top portion.

Referring now to FIGS. 17–24, an alternate mounting arrangement for the cover is disclosed. Cover 50 is disclosed as including a plurality of hooks 120 connected to top portion 52 of cover 50. Hooks 120 are disclosed as being symmetrically oriented about the top portion of the cover; however, other orientations can be used. Hook 120 is mounted in mount 126 which in turn is connected to top portion 52 of cover 50. Hook 120 may be rigidly secured in mount 126 or at least partially rotate about and/or adjust upwardly within mount 126. Hook 120 includes hook legs 122 and 124. Hook leg 122 is designed to be secured to mount 126. Hook leg 124 is designed to engage or penetrate ground surface 150 around golf hole 160. Hook 120 and mount 126 may be made of the same or different materials. Preferably, hook 120 is made of a corrosion-resistant, resilient material such as, but not limited to, plastic, rubber, metal, or the like. Mount 126 preferably is made up of a corrosion-resistant, resilient material such as plastic, metal or the like. Cover 50 includes an opening 110 designed to facilitate in the handling of cover 50 during the insertion and removal of the cover about golf hole 160. The attributes of opening 110 are similar to those as described with respect to FIGS. 9–16, and will not be further repeated. As can be appreciated, hook 120 may include more than one hook leg 124 so as to provide additional support and stability when golf insert 40 is inserted about golf hole 160.

When inserting the golf insert 40 about golf hole 160, cover 50 is partially inserted into the golf hole 160 until the bottom of hook legs 124 engage and/or penetrate into ground surface 150 thereby securing golf insert 40 about the golf hole. When golf insert 40 is removed from golf hole 160, cover 50 is upwardly lifted from golf hole 160 thereby causing the ends of hook legs 124 to release from the ground surface. If one or more hooks 120 are moveable within mount 126, hooks 120 are preferably positioned to contact a desired ground surface area around golf hole 160.

Figure 17:
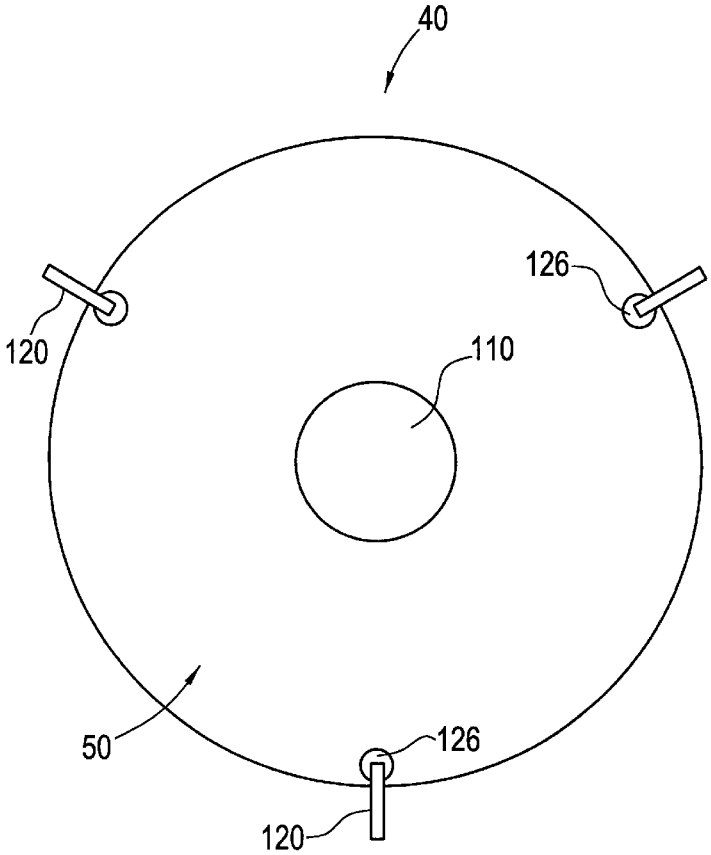
FIG. 17 is a top-elevation view of another alternative embodiment of the golf hole insert in accordance with the present invention.
Figure 18:
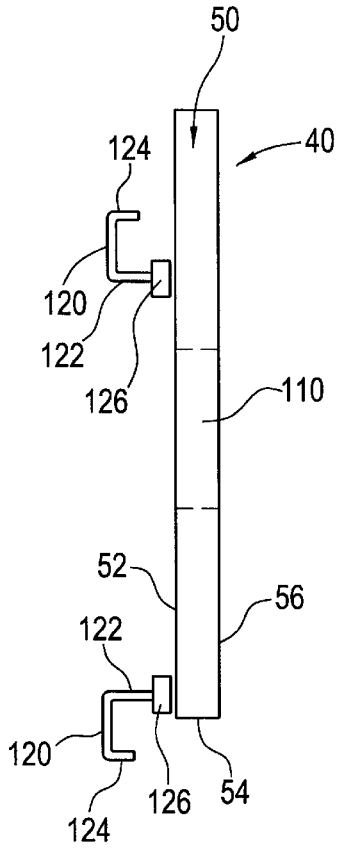
FIG. 18 is a cross-sectional view of the side of the golf hole insert of FIG. 17.
Figure 19:
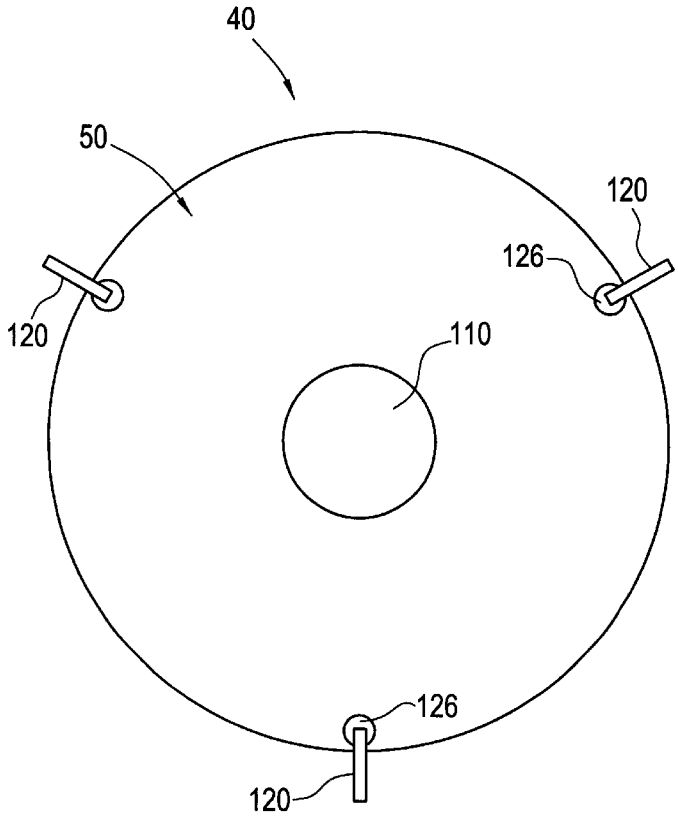
FIG. 19 is a top-elevation view of yet another alternative embodiment of the golf hole insert in accordance with the present invention.
Figure 20:
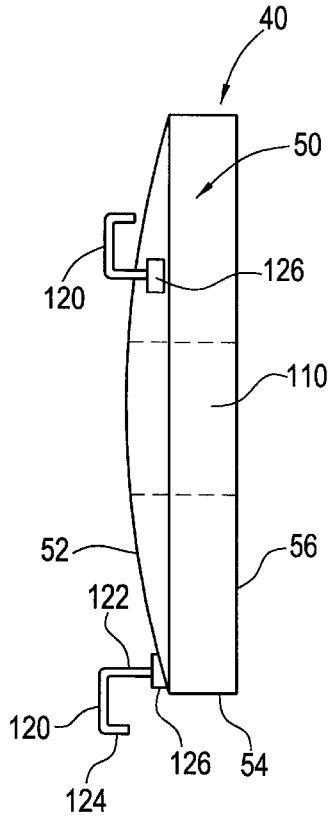
FIG. 20 is a cross-sectional view of the side of the golf hole insert of FIG. 10.
Figure 21:
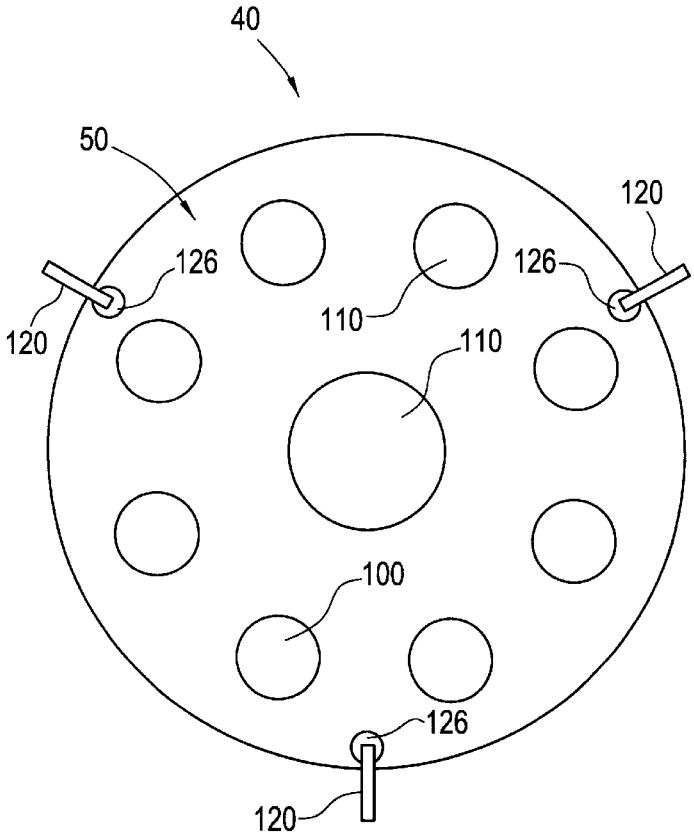
FIG. 21 is a top-elevation view of still another alternative embodiment of the golf hole insert in accordance with the present invention.
Figure 22:
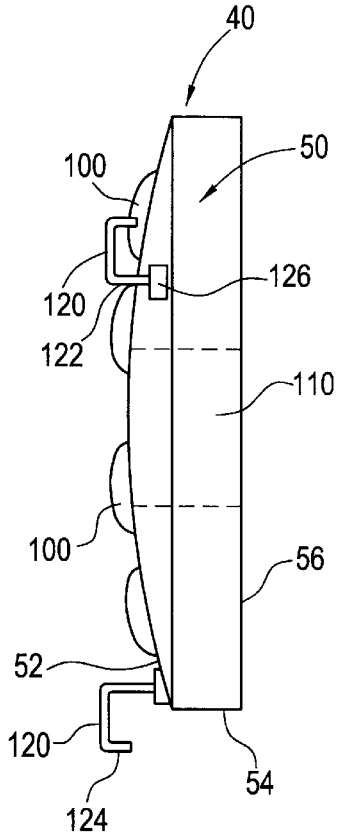
FIG. 22 is a cross-sectional view of the side of the golf hole insert of FIG. 21.
Figure 23:
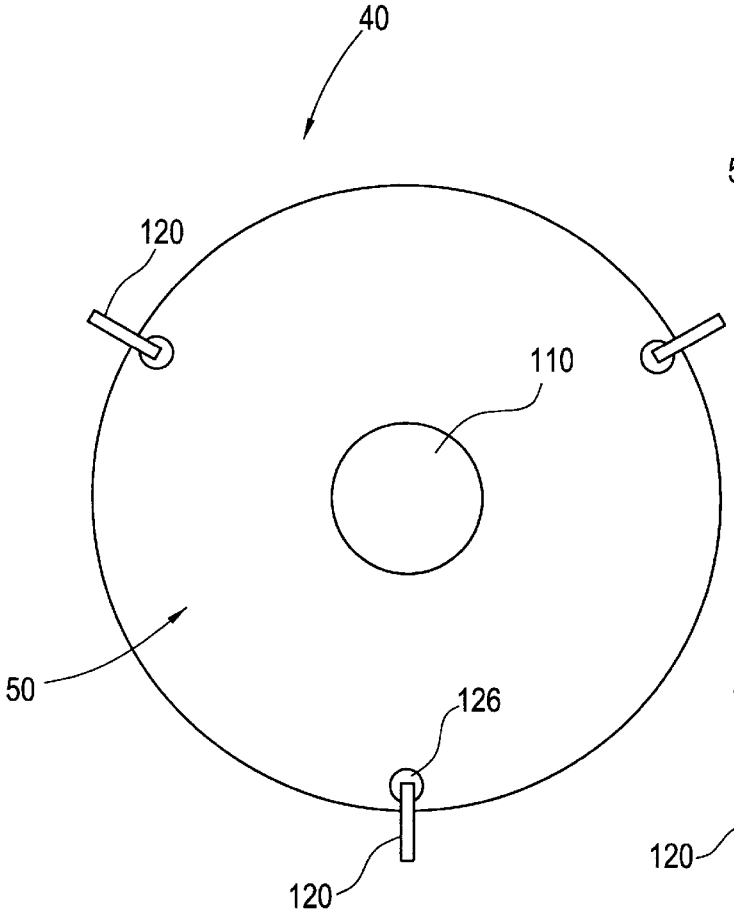
FIG. 23 is a top-elevation view of yet another alternative embodiment of the golf hole insert in accordance with the present invention.
Figure 24:
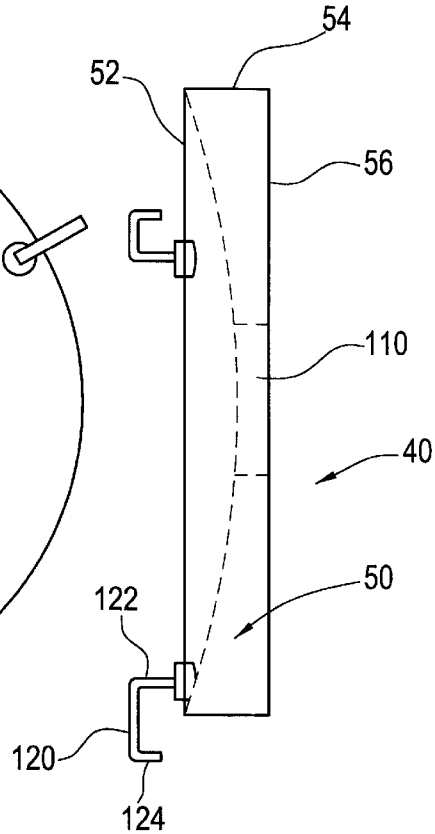
FIG. 24 is a cross-sectional view of the side of the golf hole insert of FIG. 23.

As disclosed in FIGS. 17–24, top portion 52 of cover 50 may have various configurations. As shown in FIGS. 17 and 18, top portion 52 is generally planar or flat. FIGS. 19 and 20 disclose top portion 52 as having a generally concave or dome-like configuration. FIGS. 21 and 22 disclose top portion 52 as having a generally concave or dome-like shape which includes a plurality of bulges or dimples 100. As best shown in FIG. 21, bulges 100 are positioned generally symmetrically about the top portion 52; however, other orientations can be used. FIGS. 23 and 24 disclose top portion 52 as having a generally convex or well-like shape. Referring now to FIGS. 25–33, another alternate mounting arrangement for cover 50 is disclosed. Cover 50 is shown as including a side flange 130. When a flange arrangement is used, the shape of cover 50 is selected so that at least a plurality of the side portion 54 of cover 50 is positioned closely adjacent to hole surface 162 when positioned about golf hole 160. Cover 50 is disclosed as being generally circular in shape. The diameter of cover 50 is selected to be at least closely equal to the diameter of golf hole 160. Side flange 130 is secured to side portion 54 and/or bottom portion 56 and extends downwardly from bottom portion 56. The length of the flange is selected to adequately stabilize cover 50 when inserted about golf hole 160. Preferably, the length of the flange is about 0.25–2.0 inches.

As shown in FIGS. 25–33, side flange 130 includes a tapered side 132 which tapers inwardly toward the middle of cover 50. The taper is preferably uniform throughout the length of the flange; however, the flange can be designed to include one or more portions that are not tapered and/or include a taper that is non-uniform with another tapered portion. Tapered side 132 of side flange 130 facilitates in the assertion of the flange at least partially into golf hole 160 to secure cover 50 in a desired position about golf hole 160. Cover 50 includes an opening 110 to allow a player to conveniently grasp the cover for easy and convenient insertion or removal of the golf insert about or from golf hole 160. The orientation and shape of opening 110 is similar to that as described in reference to FIGS. 9–16, and will not further be described.

The flange may be formed uniformly with cover 50 or be attached to cover 50 by glue, tape, snaps, melting or the like. Preferably, side flange 130 is made of the same material as cover 50; however, side flange 130 may be made up of different materials.

Figure 26:
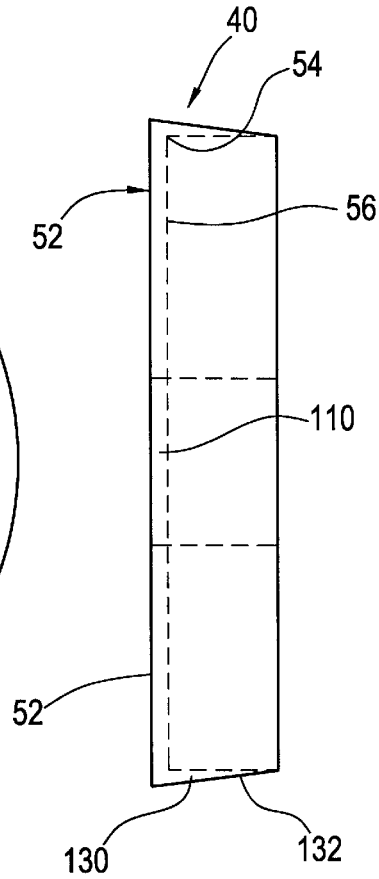
FIG. 26 is a cross-sectional view of the side of the golf hole insert of FIG. 25.
Figure 27:
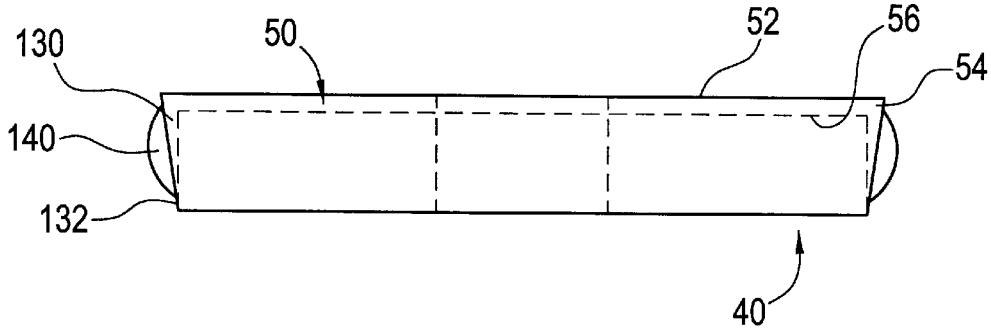
FIG. 27 is a modified cross-sectional view of the side of the golf hole insert of FIG. 25.

Referring now to FIG. 27, a modification to the side flange arrangement is disclosed. FIG. 26 discloses the side flange including a plurality of side bulges 140. Preferably, the side bulges are oriented symmetrically about side flange 130; however, other arrangements can be used. The side bulges are shown to be semi-circular in design; however, other shapes of the bulges can be used. The side bulges 140 extend outwardly from side flange 130 and are designed to contact hole surface 162 within golf hole 160 to thereby help stabilize and secure golf insert 40 when inserted about golf hole 160. Side bulges 140 are preferably formed in side flange 130; however, side bulges 140 can be attached to the outer surface of side flange 130 such as by glue, snaps, melting or the like.

Figure 25:
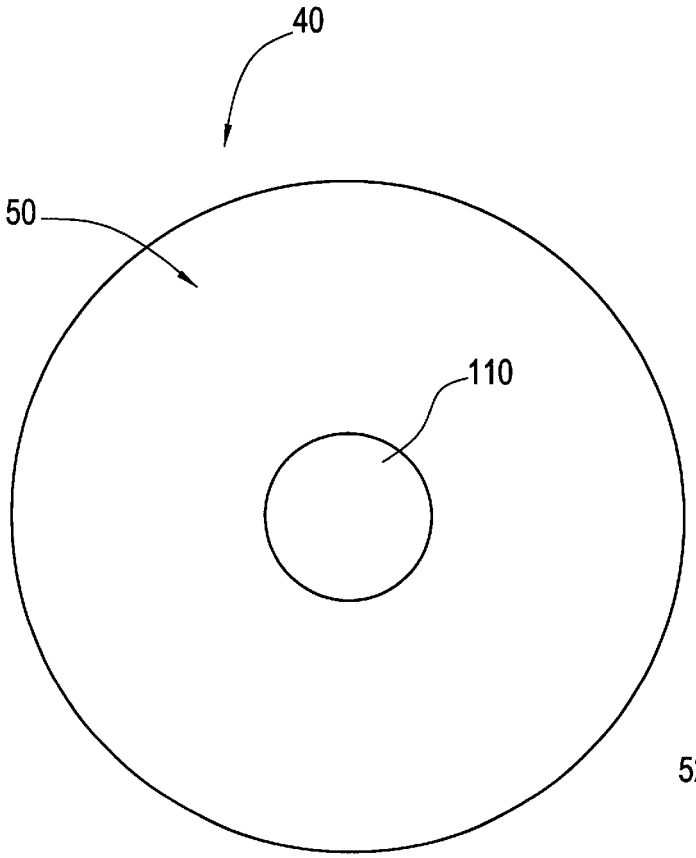
FIG. 25 is a top-elevational view of still yet another alternative embodiment of the golf hole insert in accordance with the present invention.
Figure 28:
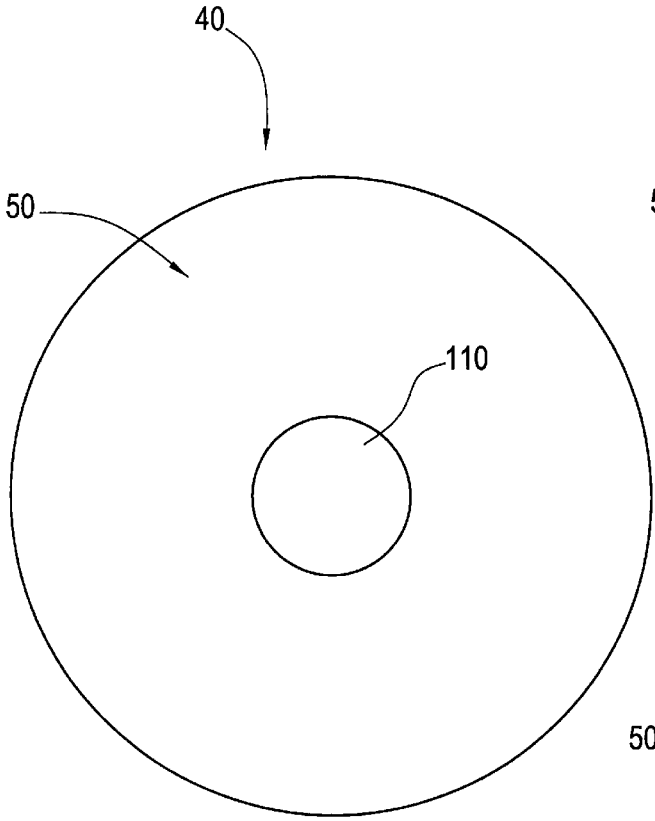
FIG. 28 is a top-elevation view of a further alternative embodiment of the golf hole insert in accordance with the present invention.
Figure 29:
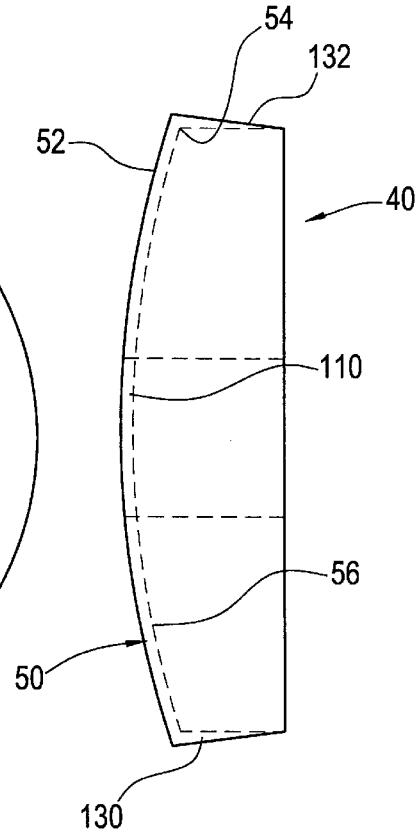
FIG. 29 is a cross-sectional view of the side of the golf hole insert of FIG. 28.
Figure 30:
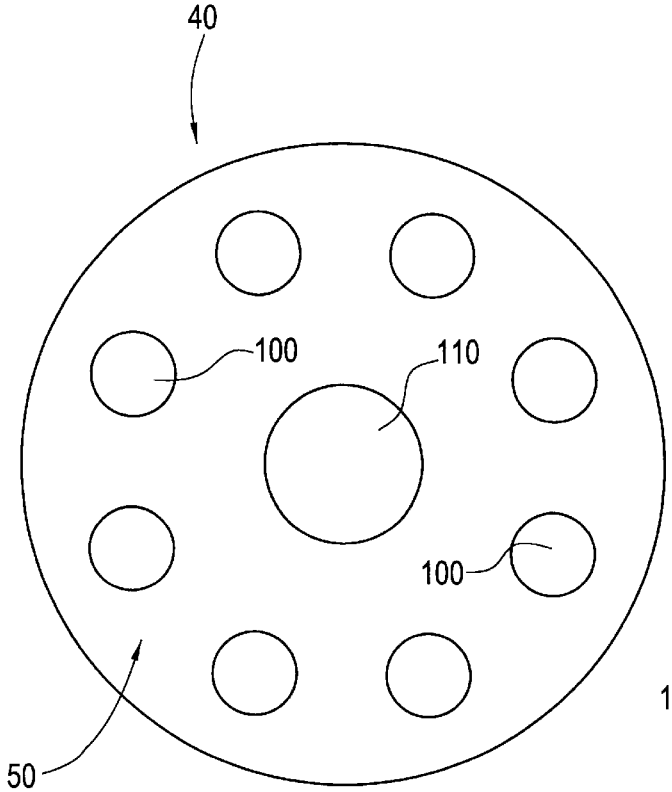
FIG. 30 is a top-elevation view of still a further alternative embodiment of the golf hole insert in accordance with the present invention.
Figure 31:
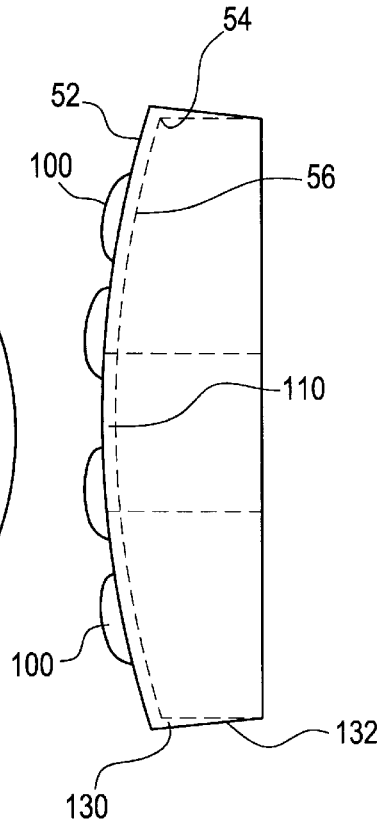
FIG. 31 is a cross-sectional view of the side of the golf hole insert of FIG. 30.
Figure 32:
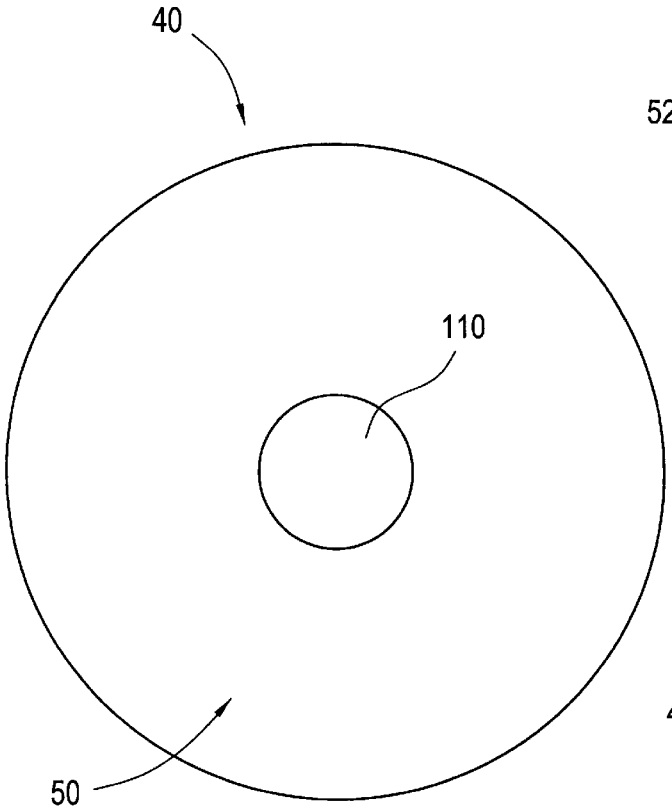
FIG. 32 is a top-elevation view of another alternative embodiment of the golf hole insert in accordance with the present invention.
Figure 33:
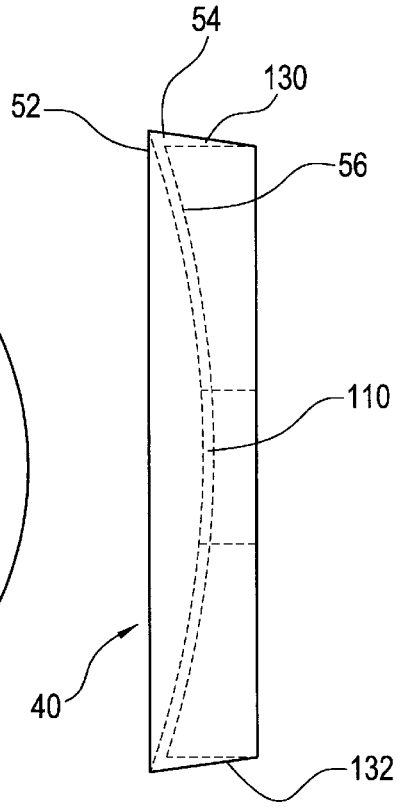
FIG. 33 is a cross-sectional view of the side of the golf hole insert of FIG. 32.

As disclosed in FIGS. 25–33, top portion 52 of cover 50 may include various designs. FIGS. 25–27 disclose top portion 52 as having a generally planar or flat design. FIGS. 28 and 29 disclose top portion 52 as having a generally concave of dome-like design. FIGS. 30 and 31 disclose top portion 52 as having a generally concave or dome-like shape which includes a plurality of bulges or dimples 100. As disclosed in FIG. 30, the plurality of bulges 100 are oriented generally symmetrically about top portion 52; however, other orientations can be used. FIGS. 32 and 33 disclose top portion 52 as having a convex or well-like shape.

Referring now to FIG. 34, one specific design of the golf insert 40 is disclosed as being inserted about golf hole 160. As can be appreciated, the various embodiments of the golf insert can be oriented about golf hole 160 in a similar manner or be oriented in a slightly different manner depending on the shape and design of the golf insert. As shown in FIG. 34, the mounting arrangement is a plurality of hooks 120 attached to cover 50 to position the cover about golf hole 160. Top portion 52 of cover 50 has a concave or dome-shaped design. In addition, cover 50 includes an opening 110 that passes through the body of cover 50. Cover 50 is shown as having a generally circular cross-sectional shape and having a diameter which is equal to or slightly less than the diameter of golf hole 160. Cover 50 is shown to be mounted such that the plane of bottom portion 56 is generally parallel to the plane of ground surface 150. In addition, cover 50 is mounted such that bottom portion 56 is spaced above the top edge of golf cup 170. As can be appreciated, the cover can be positioned about the golf hole such that bottom portion 56 at least partially rests on golf cup 170. A portion of cover 50 is shown to be positioned below the ground surface 150, a portion of the cover is disclosed as being generally parallel to the ground surface 150, and a portion of the cover is shown to be positioned above ground surface 150. The intended use and design of cover 150 will generally dictate the orientation of cover 50 with respect to ground surface 150.

One or more materials can be used to form golf insert 40. Preferably, the materials are designed to be resilient to wear, resilient to the exposure to various elements, and resist corrosion. One preferable material for cover 50 is a generally hard plastic material that resists degradation when exposed to water and resists cracking and deformation upon contact by a golf ball. The plastic material maybe transparent or have one or more colored portions. The cover may include one or more markings for informational purposes and/or for visual purposes. The pins, fingers and/or hooks used with cover 50 are generally rigid structures such as plastic, metal, wood or the like. The end portions of the pin and/or the finger can be tapered to facilitate in the insertion of the end into the ground.

The invention has been described with reference to a preferred embodiment and alternates thereof. It is believed that many modifications and alterations to the embodiment as discussed herein will readily suggest themselves to those skilled in the art on reading and understanding the detailed description of the invention. It is intended to include all such modifications and alterations in so far as they come within the scope of the present invention.

I claim:

1. A golf hole insert to be inserted in a golf hole and to prevent a golf ball from fully dropping into a golf hole having a peripheral wall, a bottom wall contiguous with the peripheral wall and a top opening opposite the bottom wall, said golf hole insert comprising a cover and a cover mount, said cover reducing the area of the top opening of said golf hole to prevent said golf ball from fully passing through the top opening of said golf hole when said cover is at least partially inserted in said golf hole, said cover mount at least partially engaging said peripheral wall to releasably secure said cover and cover mount in said golf hole and suspending said cover and cover mount above said bottom wall of said golf hole.

2. The insert as defined in claim 1, wherein said cover includes a generally transparent material.

3. The insert as defined in claim 1, wherein said cover includes visual markings.

4. The insert as defined in claim 1, wherein said cover has a substantially circular shaped top portion.

5. The insert as defined in claim 2, wherein said cover has a substantially circular shaped top portion.

6. The insert as defined in claim 1, wherein said cover includes an opening in a top portion of said cover, said opening having a shape and size to prevent said golf ball from passing through said opening.

7. The insert as defined in claim 4, wherein said cover includes an opening in a top portion of said cover, said opening having a shape and size to prevent said golf ball from passing through said opening.

8. The insert as defined in claim 5, wherein said cover includes an opening in a top portion of said cover, said opening having a shape and size to prevent said golf ball from passing through said opening.

9. The insert as defined in claim 6, wherein said opening having a generally circular shape.

10. The insert as defined in claim 9, wherein said opening is positioned in the middle of said top portion.

11. The insert as defined in claim 1, wherein said cover includes a top portion having a generally flat surface.

12. The insert as defined in claim 10, wherein said cover includes a top portion having a generally flat surface.

13. The insert as defined in claim 1, wherein said cover mount includes a plurality of extension members position on a side of said cover, said extension members adapted to engage said peripheral wall of said golf hole secure said cover in said golf hole.

14. The insert as defined in claim 7, wherein said cover mount includes a plurality of extension members position on a side of said cover, said extension members adapted to engage said peripheral wall of said golf hole secure said cover in said golf hole.

15. The insert as defined in claim 12, wherein said cover mount includes a plurality of extension members position on a side of said cover, said extension members adapted to engage said peripheral wall of said golf hole secure said cover in said golf hole.

16. The insert as defined in claim 13, wherein said cover mount includes three extension members symmetrically positioned about the side of said cover.

17. The insert as defined in claim 15, wherein said cover mount includes three extension members symmetrically positioned about the side of said cover.

18. The insert as defined in claim 1, wherein said cover includes at least one indent on a perimeter of said cover, said indent having a shape and size to prevent said golf ball from passing through said indent when said cover is inserted in said golf hole.

19. The insert as defined in claim 18, wherein said indent has an arcuate shape.

20. The insert as defined in claim 18, wherein said cover includes three indents symmetrically positioned about the perimeter of said cover.

21. The insert as defined in claim 18, wherein said cover includes a top portion having a generally concave surface.

22. The insert as defined in claim 1, wherein said cover includes a top portion having a generally convex surface.

23. The insert as defined in claim 1, wherein said cover includes a top portion having a dimpled region.

24. The insert as defined in claim 17, wherein said cover mount securing said top portion of said cover level with the top of said golf hole.

25. The insert as defined in claim 17, wherein said cover mount securing said top a portion of said cover below the top of said golf hole.

26. The insert as defined in claim 13, wherein said extension member is substantially rigidly affixed to said cover.

27. The insert as defined in claim 24, wherein said extension member is substantially rigidly affixed to said cover.

28. The insert as defined in claim 13, wherein said extension member at least partially retractable into said cover.

29. The insert as defined in claim 13, wherein said extension member is biased to project from the side of said cover.

30. The insert as defined in claim 13, wherein at least one extension member is movable between an extended and a retracted position, at least a portion of said extension member penetrating said peripheral wall of said golf hole when said cover is inserted in said golf hole and said extension member is positioned in said extended position.

31. The insert as defined in claim 29, wherein said extension member is biased by a spring.

32. The insert as defined in claim 30, wherein said cover includes at least one member passage extending at least partially through said cover, said member passage sized to enable one of said extension members to at least partially move within said member passage between said extended and retracted positions.

33. The insert as defined in claim 1, wherein said cover mount includes at least one hook member.

34. The insert as defined in claim 33, wherein said hook member is secured to a top portion of said cover at a point closely adjacent to a peripheral edge of said cover.

35. The insert as defined in claim 33, wherein said cover mount includes three hook members symmetrically spaced on said cover.

36. The insert as defined in claim 33, wherein at least one of said hook members is adjustably positionable on said cover.

37. The insert as defined in claim 1, wherein said cover mount includes a flange secured to said cover and extending downwardly from said cover, said flange at least partially tapering inward towards the middle of said cover.

38. The insert as defined in claim 37, wherein said flange substantially continuously tapers inwardly.

39. The insert as defined in claim 1, wherein said cover is formed of a plastic material.

40. The insert as defined in claim 1, wherein said cover mount includes a flange secured to said cover and extending downwardly from said cover, said flange including at least one bulge extending outwardly from said flange and adapted to contact the peripheral wall of said golf hole when said cover is inserted into said golf hole.

41. The insert as defined in claim 1, wherein said opening is positioned spaced from a perimeter of said cover.

42. The insert as defined in claim 1, wherein said cover includes a top portion and said cover mount securing said top portion level with the top of said golf hole.

43. The insert as defined in claim 1 wherein said cover includes a top portion and said cover mount securing said top portion slightly above the top of said golf hole.

44. The insert as defined in claim 1, wherein said cover includes a top portion and said cover mount securing said top portion slightly below the top of said golf hole.

45. A golf hole insert to be inserted in a golf hole and to prevent a golf ball from fully dropping into a golf hole having a peripheral wall, a bottom wall contiguous with the peripheral wall and a top opening opposite the bottom wall, said golf hole insert comprising a cover and a cover mount, said cover reducing the area of the top opening of said golf hole to prevent said golf ball from fully passing through the top opening of said golf hole when said cover is at least partially inserted in said golf hole, said cover mount at least partially engaging said peripheral wall to releasably secure said cover and cover mount in said golf hole, said cover and cover mount being suspended above said bottom wall of said golf hole when inserted in said golf hole.

46. The insert as claimed in claim 45, wherein said cover includes an opening, said opening being spaced from a perimeter of said cover, said opening having a shape and a size to prevent said golf ball from passing through said opening.

* * * * *